US005690525A

United States Patent [19]

Bing

[11] Patent Number: 5,690,525

[45] Date of Patent: Nov. 25, 1997

[54] FLOATING HEADREST

[76] Inventor: Stephen W. Bing, 7714 Creek Glen, Houston, Tex. 77095

[21] Appl. No.: 791,356

[22] Filed: Jan. 30, 1997

[51] Int. Cl.[6] ..... B63C 9/08

[52] U.S. Cl. ..... 441/129; 441/124; 441/88

[58] Field of Search ..... 441/80, 88, 129, 441/124, 136, 123; 472/128, 129; D21/237, 238

[56] References Cited

U.S. PATENT DOCUMENTS 3,771,181 11/1973 Dansereau ..... 441/129

4,861,300 8/1989 Cassgrande et al. ..... 441/131

5,562,514 10/1996 Rowe ..... 441/129

*Primary Examiner*—Edwin L. Swinehart

[57] ABSTRACT

A floating headrest is formed of a unitary member of expanded plastic such as polyethylene. The headrest includes two raised end sections, between which, the rider's head lays. The headrest includes a cylindrical hole bored from the forward surface to the rear surface to allow the insertion of other tubular flotation devices. The headrest is designed such that the center of buoyancy of the combined headrest, said tubular flotation device, and rider is significantly below the surface of the water, leaving the rider's head out of the water.

2 Claims, 7 Drawing Sheets

FLOATING HEADREST

BACKGROUND—FIELD OF INVENTION

This invention relates to a recreational flotation device for augmenting the buoyancy of an individual, and more particularly, to a floating headrest that allows the user to lean back to any desired position, including the horizontal position, while maintaining the user's head above the water line.

BACKGROUND—DESCRIPTION OF PRIOR ART

There have been flotation devices for individuals to hold or improve their buoyancy for many years. More recently, there have been innumerable plastic flotation devices for recreational use such as floating lounges and floating recliners.

U.S. Pat. No. 5,052,965 to Klapp (1989) discloses a floating recliner; however, it cannot be easily used in conjunction with certain tubular expanded foam plastic floating devices presently on the market. Additionally, the said floating recliner appears to be of relatively expensive construction, being a conglomerate of five separate pieces of polyethylene and one sheet of waterproof material cut into the shape of said recliner.

U.S. Pat. No. 5,443,409 to Adamson (1995) discloses a water saddle on which a rider sits in an upright position, without having the ability to comfortably recline in the water.

It has been found that there is a desire on the part of many individuals for a simple, inexpensive floating headrest allowing the user to recline in the water while maintaining the user's head above the water line.

OBJECTS AND ADVANTAGES

Objects and advantages of the present invention are:

(a) to provide a lightweight, non-inflatable floating headrest which may be used alone, or in conjunction with other recreational flotation devices (such as those certain tubular flotation devices constructed from expanded polyethylene plastic); and, (b) to provide a floating headrest which can be brightly colored; and, (c) to provide a floating headrest which can be economically produced through an extrusion or die-cut process.

Still further objects and advantages will become apparent from a consideration of the ensuing description and drawings.

DESCRIPTION OF THE DRAWINGS

This invention may be more clearly understood with the following detailed description and by reference to the drawings in which.

SUMMARY AND OPERATION OF THE INVENTION

The invention described herein consists of a floating headrest formed of a unitary member of expanded plastic such as polyethylene. The center of the headrest has a hole for the optional receipt of the insertion of a tubular flotation device. The rider may grasp the said attached tubular flotation device between his or her legs while reclining backwards and resting his or her head onto the said floating headrest. While the rider's body and head are so held, the rider is in a reclining or prostrate position while his or her head is maintained out of the water.

DETAILED DESCRIPTION OF THE INVENTION

Figure 1:
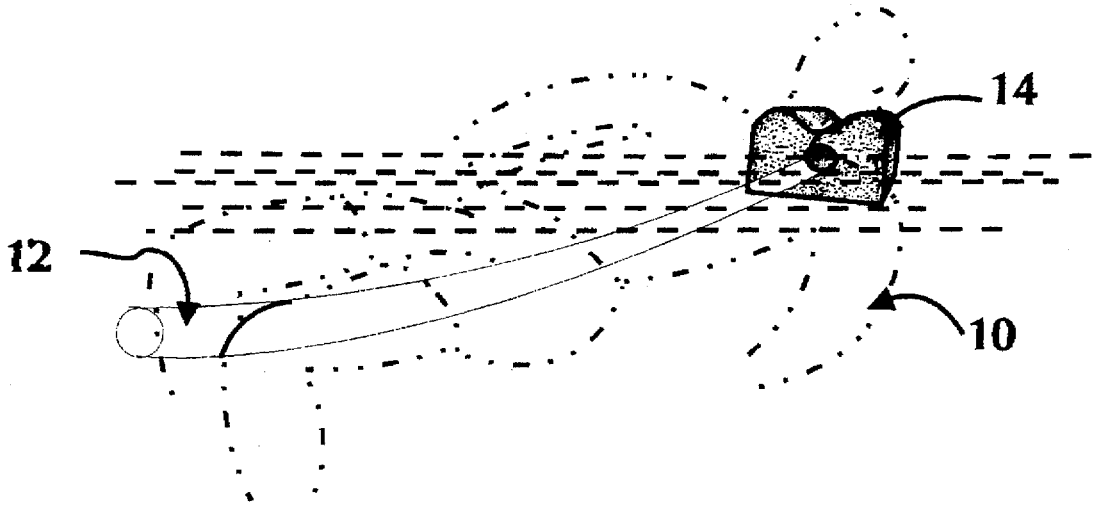
FIG. 1 is a perspective view of the floating headrest of the present invention shown as being attached to a tubular flotation device, with a rider shown in phantom with said rider's head laying upon the said floating headrest.

FIG. 1 is a perspective view of the present invention shown in the water with a rider. The rider 10 is shown reclining upon a tubular flotation device 12 with the rider's head resting upon the floating headrest 14. The weight of the rider 10 is such as to keep the tubular flotation device 12 submerged with only a portion of the upper part of the rider's body and the entirety of the rider's head being supported out of the water by the floating headrest 14. The center of buoyancy of the combined rider 10, tubular flotation device 12 and the floating headrest 14 is significantly below the surface of the water in which they are placed so that as long as the rider straddles the tubular flotation device 12 between his legs and lays his head upon the floating headrest 14, there is little tendency for the rider 10 to be tipped or capsized.

Figure 2:
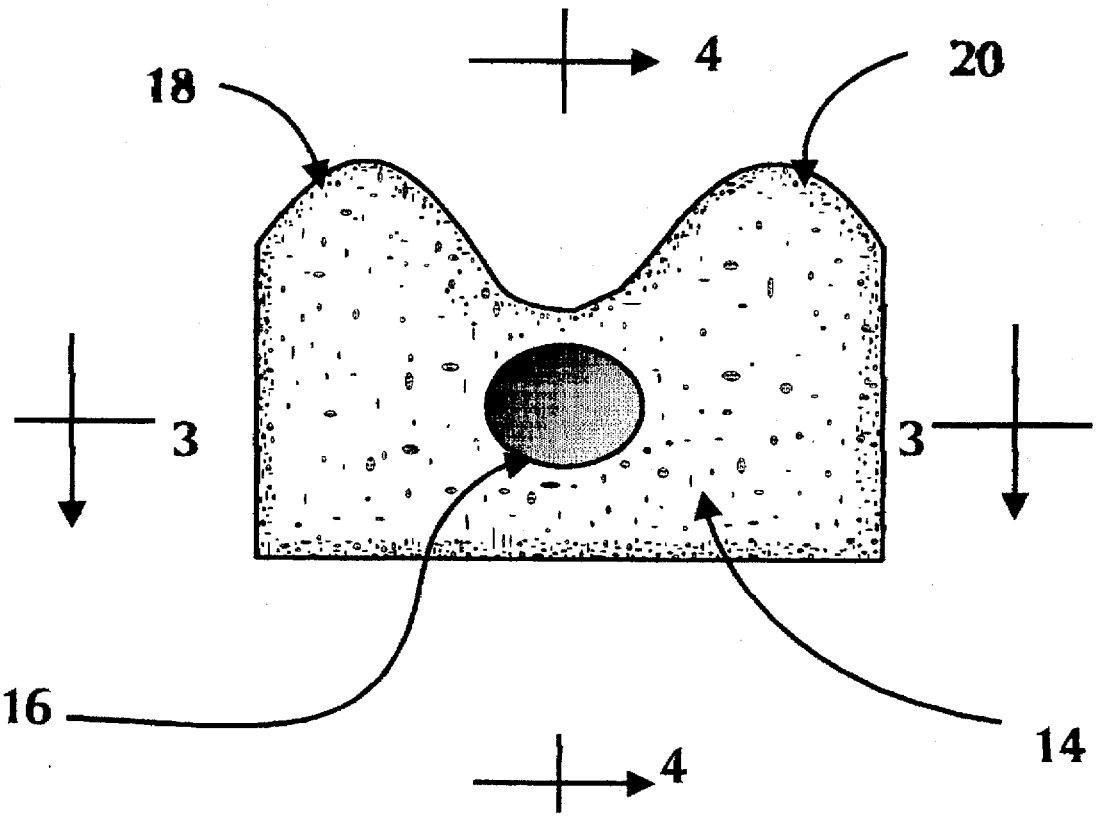
FIG. 2 is a side elevational view of the present invention.

FIG. 2 is a side elevational view of the floating headrest 14 which includes a centrally located hole 16 for reception of aforementioned tubular flotation device, and raised end portions 18 and 20, which stabilize the rider's head.

Figure 3:
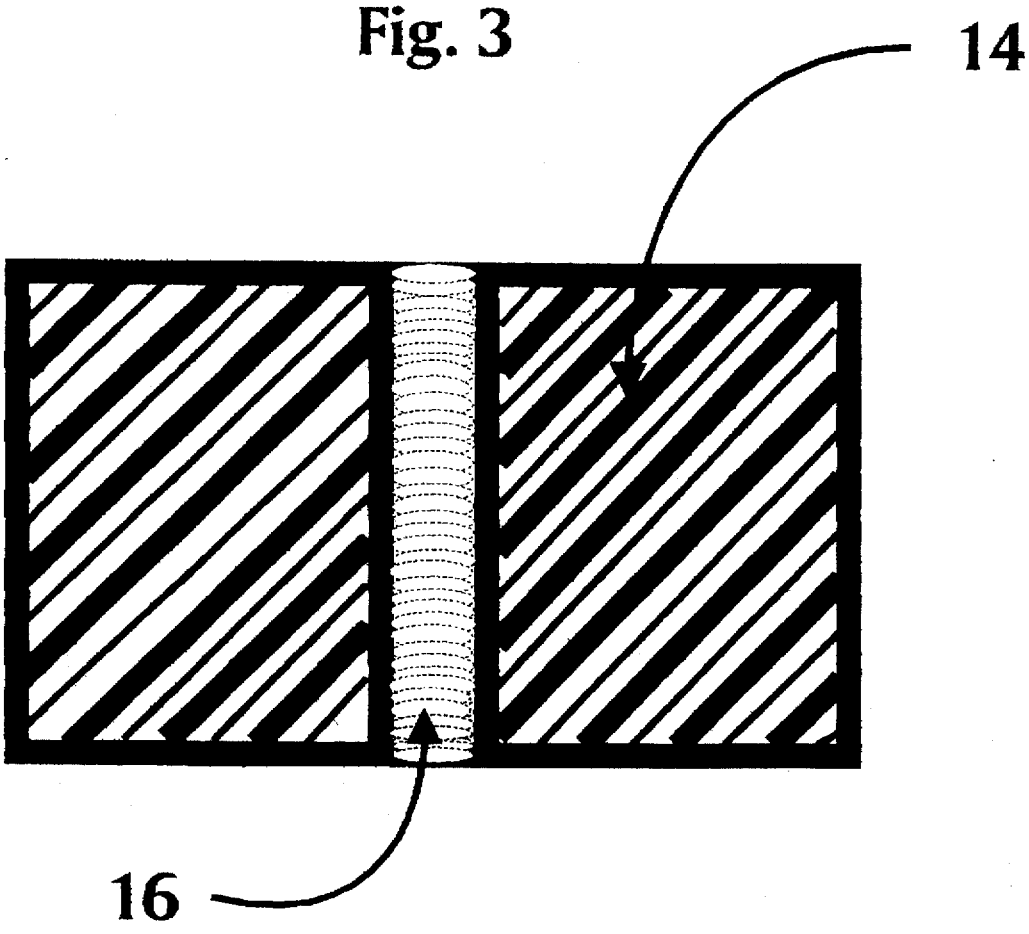
FIG. 3 is a sectional view taken along line 3—3 of FIG. 2.

FIG. 3 is a sectional view of the floating headrest 14 taken along line 3—3 of FIG. 2 cutting through the hole 16.

Figure 4:
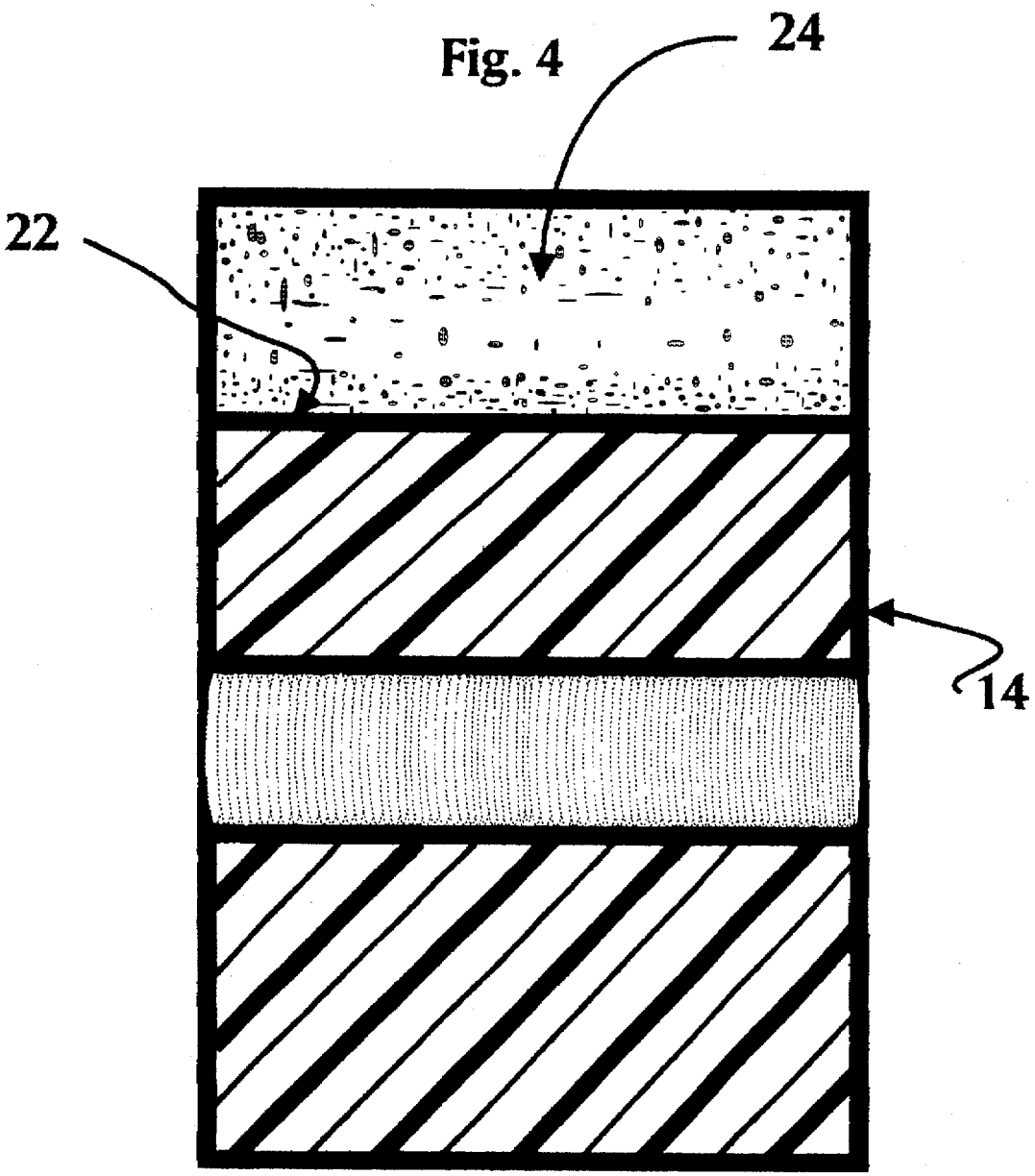
FIG. 4 is a sectional view taken along line 4—4 of FIG. 2.
Figure 5:
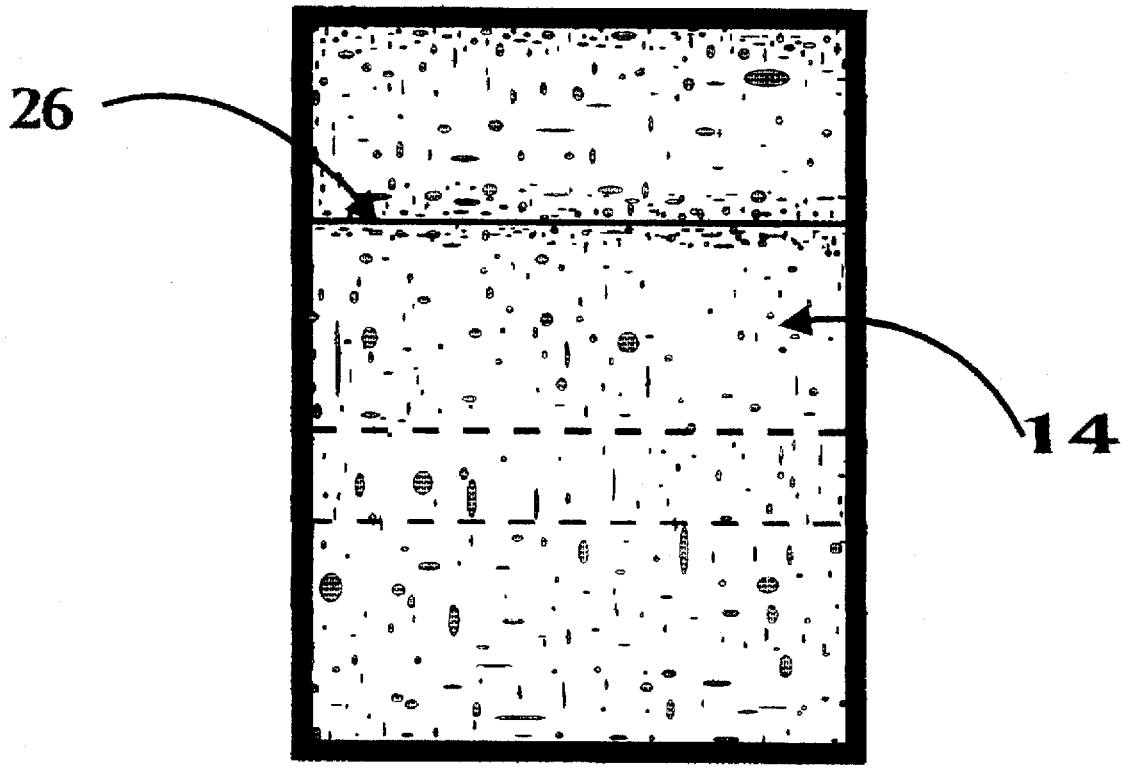
FIG. 5 is an end view of the present invention of FIG. 2.

FIG. 4 is also a sectional view, but taken along line 4—4 of FIG. 2. This view shows that the floating headrest 14 reaches a minimum height at its top center line 22, with the raised end portions arching upwardly and extending from the top center line 22. The curved contour of the top surface 24 is shown, which curvature extends from just above section line 3—3 on both ends of the floating headrest 14. This dividing line 26 is shown on FIG. 5 which is an end view of the floating headrest 14. The end views are the same since the floating headrest 14 is symmetrical side to side and end to end.

Figure 6:
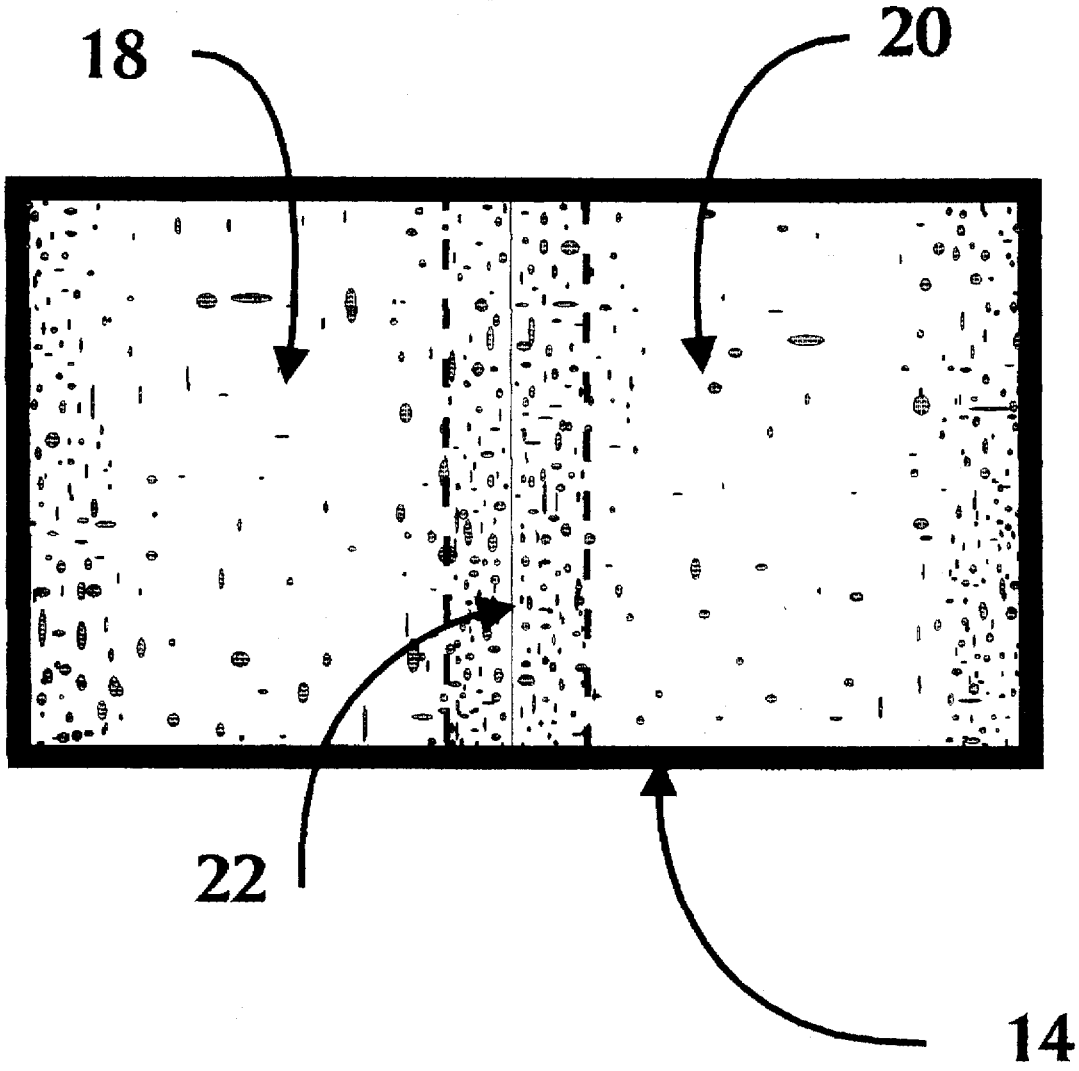
FIG. 6 is a top plan view of the present invention of FIG. 2.
Figure 7:
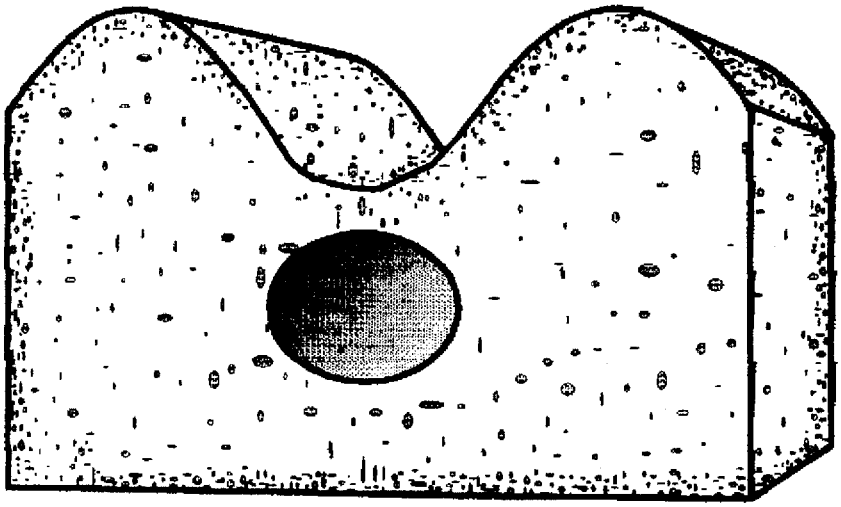
FIG. 7 is a perspective view of the present invention of FIG. 2.

FIG. 6 is a top plan view of the floating headrest 14 and shows the top center line 22 portion and the raised end portions 18 and 20.

As stated above, the floating headrest 14 is preferably molded of expanded polyethylene. Other expanded materials might be used. It has been determined that one size of the floating headrest is satisfactory for most individuals weighing from approximately 135 lbs. to 250 lbs. A smaller headrest is appropriate for individuals from approximately 80 lbs. to 135 lbs.

The above described embodiments of the present invention are merely descriptive of its principles and are not to be considered limiting. The scope of the present invention instead shall be determined from the scope of the following claims including their legal equivalents.

What is claimed is:

1. A floating headrest for the use in the water by a rider, said headrest comprising a unitary member of polyethylene or polystyrene, top surface of said headrest having two raised ends, each said raised end extending in a continuous smooth curved convex surface from a top center line, forward and rear surfaces of said headrest being flat with a cylindrical hole bored from the forward surface to the rear surface, with said hole having the capacity to receive a tubular flotation device, a bottom surface of said headrest being flat, said headrest being substantially symmetrical on either side of said top center line.

2. A floating headrest as claimed in claim 1 wherein the buoyancy of said member is such that said rider's head, when laying upon said member, is supported with at least the rider's head out of the water.

* * * * *